US006247844B1

(12) United States Patent
Tomic et al.

(10) Patent No.: US 6,247,844 B1
(45) Date of Patent: Jun. 19, 2001

(54) RESEALABLE SLIDER CLOSURE MECHANISM WITH SEPARATE PLOW

(75) Inventors: Mladomir Tomic; Gregory L. Petkovsek, both of Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/187,360

(22) Filed: Nov. 6, 1998

(51) Int. Cl.[7] ..... B65D 33/16
(52) U.S. Cl. ..... 383/64; 24/400
(58) Field of Search ..... 383/64, 97; 24/399, 24/400, 430

(56) References Cited

U.S. PATENT DOCUMENTS

| | | | | |
|---|---|---|---|---|
| 2,289,586 | * | 7/1942 | Marinsky et al. | 383/97 X |
| 2,579,747 | | 12/1951 | Martin . | |
| 3,153,269 | * | 10/1964 | Berry | 24/400 |
| 3,234,614 | * | 2/1966 | Plummer | 24/400 |
| 3,574,247 | * | 4/1971 | Jakob | 24/430 |
| 3,579,747 | * | 5/1971 | Hawley | 24/400 |
| 3,660,875 | | 5/1972 | Gutman . | |
| 3,755,993 | * | 9/1973 | Cote | 383/87 X |
| 3,790,992 | * | 2/1974 | Herz | 24/400 |
| 3,959,856 | | 6/1976 | Ausnit . | |
| 5,007,142 | | 4/1991 | Herrington . | |
| 5,007,143 | | 4/1991 | Herrington . | |
| 5,010,627 | | 4/1991 | Herrington et al. . | |
| 5,020,194 | | 6/1991 | Herrington et al. . | |
| 5,063,644 | | 11/1991 | Herrington et al. . | |
| 5,067,208 | | 11/1991 | Herrington, Jr. et al. . | |
| 5,070,583 | | 12/1991 | Herrington . | |
| 5,088,971 | | 2/1992 | Herrington . | |
| 5,131,121 | | 7/1992 | Herrington, Jr. et al. . | |
| 5,189,764 | | 3/1993 | Herrington et al. . | |
| 5,283,932 | | 2/1994 | Richardson et al. . | |
| 5,301,395 | | 4/1994 | Richardson et al. . | |
| 5,426,830 | | 6/1995 | Richardson et al. . | |
| 5,431,760 | | 7/1995 | Donovan . | |
| 5,442,837 | | 8/1995 | Morgan . | |
| 5,664,299 | | 9/1997 | Porchia et al. . | |
| 5,956,815 | * | 9/1999 | O'Connor et al. | 24/400 X |
| 5,983,466 | * | 11/1999 | Petkovsek | 24/400 |

FOREIGN PATENT DOCUMENTS

| | | |
|---|---|---|
| WO 92/17085 | 10/1992 | (EP) . |
| WO 92/17086 | 10/1992 | (EP) . |
| WO 92/17087 | 10/1992 | (EP) . |

* cited by examiner

*Primary Examiner*—Jes F. Pascua

(57) ABSTRACT

A resealable slider closure mechanism includes a first closure profile, a second closure profile, a slider, and a plow. The plow is a separate piece that is attached to the slider at a later time. The plow has an attachment peg extending from it, while the slider has a cavity adapted to receive the attachment peg. The attachment peg is press-fitted, snap-fitted, or welded into the cavity. Alternatively, the plow has a tongue instead of an attachment peg while the slider has a groove instead of a cavity adapted to receive the tongue. The tongue is press-fitted, snap-fitted, or welded into the groove. The slider and the plow are designed to receive the first and second closure profiles, to slide along the first and second closure profiles in a first direction to cause the first and second closure profiles to engage, and to slide along the first and second closure profiles in a second direction to cause the first and second closure profiles to disengage. Furthermore, a plow for use with a closure arrangement having first and second closure profiles includes first and second side walls that are tapered at one end to cause the first and second closure profiles to engage.

5 Claims, 4 Drawing Sheets

RESEALABLE SLIDER CLOSURE MECHANISM WITH SEPARATE PLOW

FIELD OF THE INVENTION

The present invention generally relates to closure arrangements for polymeric packages and, in particular, to resealable slider closure mechanisms for resealable packages.

BACKGROUND

Many packaging applications use resealable containers to store various types of articles and materials. These packages may be used to store and ship food products, non-food consumer goods, medical supplies, waste materials, and many other articles.

Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

Some types of resealable closure mechanisms are opened and closed using slider closure mechanisms. Typical rescalable slider closure mechanism designs include a separator or plow-type structure at one end that opens the mechanism when the slider travels in one direction along the mechanism. The side walls of the slider are tapered at the opposite end so as to close the mechanism when the slider travels along the mechanism in the opposite direction. Side seals on the side of the resealable closure mechanism keep the slider from sliding off the package in either direction.

Concerns are raised regarding resealable slider closure mechanisms. One such concern is that attaching the slider to the closure mechanism can be difficult because the plow must be fitted between and under the closure profiles.

SUMMARY OF THE INNVENTION

In one aspect of the present invention, one example embodiment involves a closure arrangement for use with a package. The closure arrangcment includes first and second closure profiles each having a base strip and an interlocking closure member. The interlocking closure members of the first and second closure profiles are designed to selectively engage. The closure arrangement also includes a slider having a top piece and a plow having a top end and a bottom end. The top end is adapted for attachment to the top piece of the slider. The slider and the plow are designed to form a first cavity for receiving the first and second closure profiles, to slide along the first and second closure profiles in a first direction to cause the first and second closure profiles to engage, and to slide along the first and second closure profiles in a second direction to cause the first and second closure profiles to disengage.

In another embodiment of the present invention, a resealable package includes first and second panel sections joined together to define an enclosed region, first and second opposite side edges, a top edge, and a mouth that provides access to the enclosed region. The resealable package also includes a closure arrangement for selectively opening and sealing the mouth. The closure arrangement has structure as previously described herein.

In yet another embodiment of the present invention, a method of manufacturing a resealable package having first and second opposing panel sections is provided. The method includes the steps of placing the first panel section adjacent to the second panel section; sealing a plurality of edges of the first panel section to corresponding edges of the second panel section; placing a resealable closure mechanism between an unsealed edge of the first panel section and a corresponding unsealed edge of the second panel section, the resealable closure mechanism extending between a first side edge of the package and a second side edge of the package; and securing the resealable closure mechanism to the first and second panel sections. The closure arrangement includes structure as previously described herein.

The above summary of the present invention is not intended to describe each illustrated embodiment or every implementation of the present invention. The figures and the detailed description that follow more particularly exemplify these embodiments.

BRIEF DESCRIPTION OF THE DRAWINGS

The invention may be more completely understood in consideration of the detailed description of various embodiments of the invention that follows in connection with the accompanying drawings in which.

Figure 1:
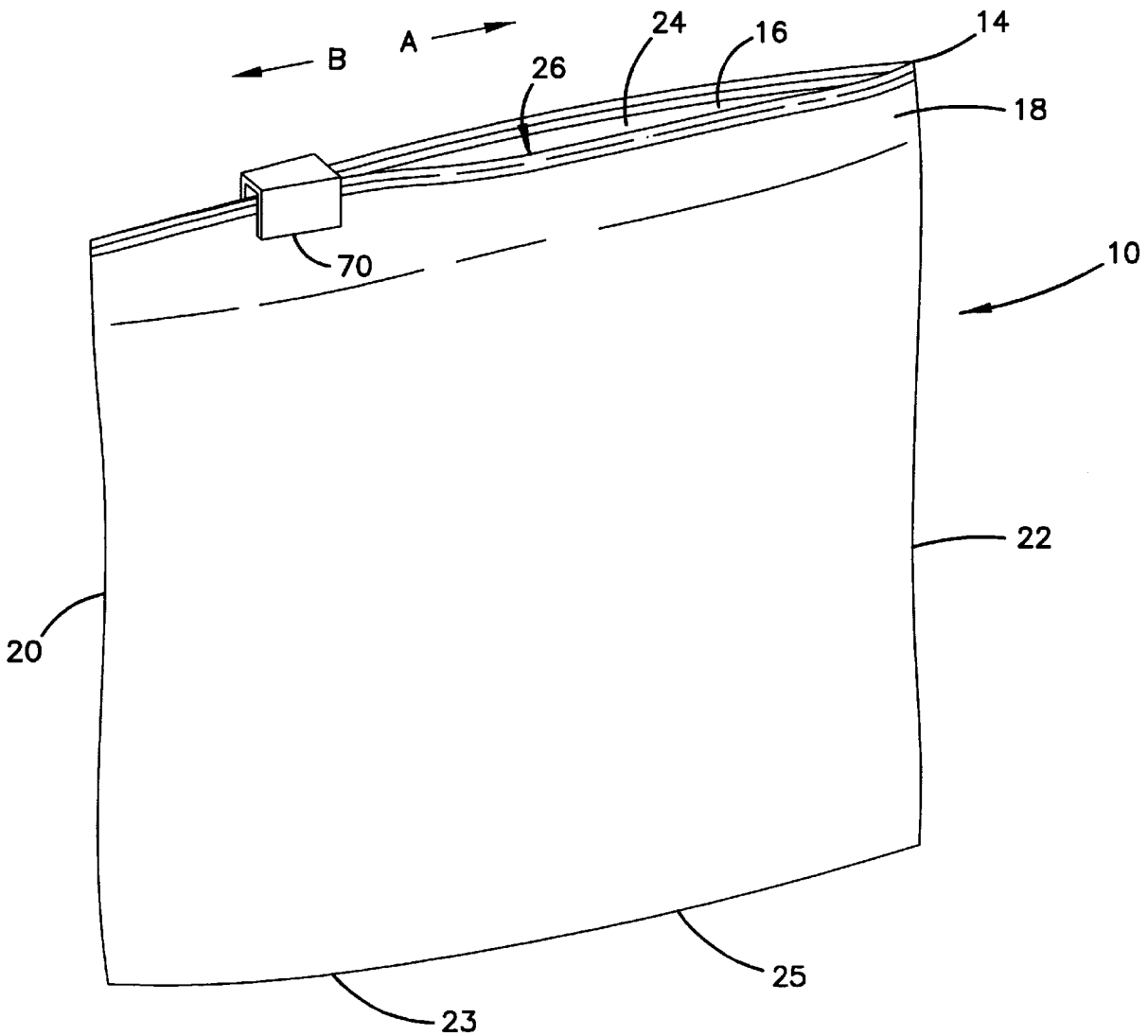
FIG. 1 is a perspective view of a flexible, resealable package, according to an example embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

The present invention is believed to be applicable to a variety of packaging arrangements. The invention has been found to be particularly advantageous for manufacturing resealable slider closure mechanisms. An appreciation of various aspects of the invention is best gained through a discussion of an application example for such a packaging arrangement.

According to an example embodiment of the present invention, a separate plow is attached to the slider during attachment of the slider to the closure mechanism. FIG. 1 illustrates an example type of package 10 that benefits from the use of such resealable slider closure mechanisms.

Attention is directed to FIG. 1. FIG. 1 illustrates an example packaging arrangement in the form of a resealable, flexible package 10 having a resealable slider closure mechanism 14 constructed in accordance with the present invention. The flexible package 10 includes first and second opposed panel sections 16, 18, typically made from a flexible, polymeric film. For some manufacturing applications, the first and second panel sections 16, 18 are heat-sealed together along two side edges 20, 22 and meet at a fold line 23 to form a three-edged containment section for a product within an interior 24 of the package 10. The fold line comprises the bottom edge 25. Alternatively, two separate panel sections 16, 18 of polymeric film may be used and heat-sealed together along the two side edges 20, 22 and at the bottom edge 25. Access is provided to the interior 24 of the package 10 through a mouth 26. The mouth 26 extends the entire width of the package 10. In other implementations, the package 10 includes tear strings or notches at the mouth 26 to assist with opening the package 10.

A resealable closure mechanism 14 is illustrated in FIG. 1 at the mouth 26 of the flexible package 10. The resealable closure mechanism 14 extends the entire width of the mouth 26. The resealable closure mechanism 14 can be one of a variety of closure mechanisms. In the particular embodiments illustrated in FIGS. 1–6, the resealable closure mechanism 14 is shown in the specific form of a resealable slider closure mechanism.

Figure 2:
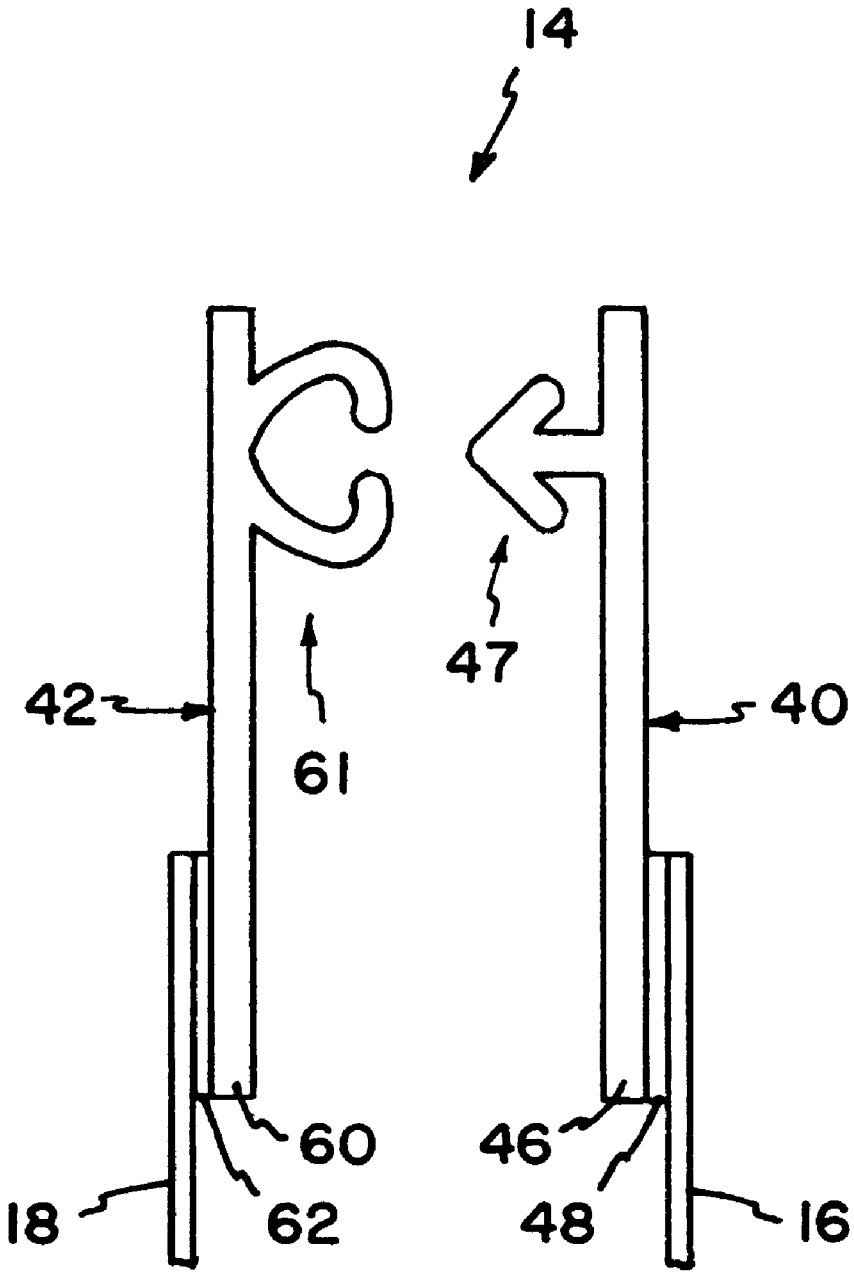
FIG. 2 is a fragmented, cross-sectional view of a resealable closure mechanism, according to an example embodiment of the present invention.

Attention is directed to FIG. 2. The male and female closure profiles 40, 42 of the resealable slider closure mechanism 14 are shown in expanded form. The closure profiles 40, 42 can be one of a variety of closure profiles. In the particular embodiment illustrated, the closure mechanism 14 is shown in the specific form of a zipper-type closure mechanism. By the term "zipper-type closure mechanism," it is meant a structure having opposite interlocking or mating profiles that, under the application of pressure, will interlock and block access between the profiles. The slider closure mechanism 14 includes an elongated male closure profile 40 and an elongated female closure profile 42. Typically, the closure profiles 40, 42 are manufactured separately from each other.

The male closure profile 40 is comprised of a base strip 46, an interlocking closure member 47, and a sealant layer 48. The sealant layer 48 is attached to a first panel section, such as the first panel section 16 of the package 10 of FIG. 1. The base strip 46 is attached to the sealant layer 48. The interlocking closure member 47 extends out from the base strip 46 and is generally perpendicular to the base strip 46. Preferably, the interlocking closure member 47 has an arrow-type shape. Alternatively, the male closure profile 40 does not have a sealant layer 48. In this alternate implementation, the base strip 46 is attached directly to the first panel section 16 of the package 10 of FIG. 1.

The female closure profile 42 is likewise comprised of a base strip 60, an interlocking closure member 61, and a sealant layer 62. The sealant layer 62 is attached to a second panel section, such as the second panel section 18 of the package 10 of FIG. 1. The base strip 60 is attached to the sealant layer 62. The interlocking closure member 61 extends out from base strip 60 and is generally perpendicular to the base strip 60. The interlocking closure member 61 is designed to receive the interlocking closure member 47 of the male closure profile 40. Alternatively, the female closure profile 42 does not have a sealant layer 62. In this alternate implementation. the base strip 60 is attached directly to the second panel section 18 of the package of FIG. 1.

The male and female closure profiles 40, 42 are designed to engage with one another to form a resealable closure mechanism 14. The interlocking closure member 47 of the male closure profile 40 and the interlocking closure member 61 of the female closure profile 42 extend from the base strips 46, 60, respectively, a sufficient distance to allow mechanical engagement therebetween. The closure profiles 40, 42 are sealed together at their ends, such as side edges 20, 22 of FIG. 1, to further aid in aligning the closure profiles 40, 42 for interlocking. Pressure is applied to the closure profiles 40, 42 as they engage and form an openable sealed closure mechanism 14. Pulling the male closure profile 40 away from the female closure profile 42 causes the two closure profiles 40, 42 to disengage, opening the package 10 of FIG. 1.

In some applications, the closure profiles 40, 42 are formed by two separate extrusions or through two separate openings of the common extrusion. Typically, the resealable closure mechanism 14 is made of a flexible polymeric material, such as polyethylene or polypropylene. In one example embodiment, the closure arrangement illustrated in FIG. 2 is manufactured using conventional extrusion and heat sealing techniques. In particular, the closure profiles 40, 42 are extruded through a die plate fed by a plurality of extruders. These extruders carry the molten materials for forming the closure profiles 40, 42. As is well known in the art, the die plate includes input ports, output ports, and channels connecting these input ports to output ports. The extruders feed the molten materials to the input ports, and the channels are designed to configure the molten materials into the shape of the closure profiles 40, 42. Typically, the sealant layers 48, 62 are coextruded with the closure profiles 40, 42, respectively, such that the sealant layers 48, 62 are bonded to the base strips 46, 60, respectively, of the male and female closure profiles 40, 42, respectively.

Figure 3:
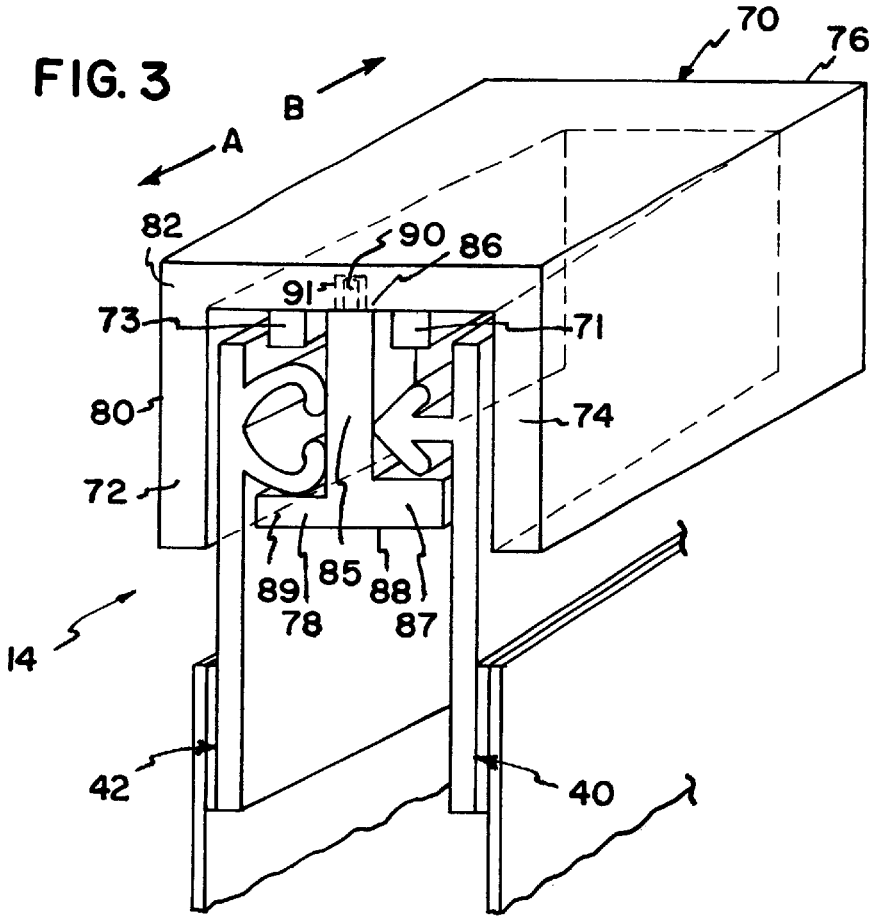
FIG. 3 is a fragmented, perspective view of an enlarged resealable slider closure mechanism, according to an example embodiment of the present invention.

Attention is directed to FIG. 3. A slider 70 opens and closes the resealable closure mechanism 14. The slider 70 has a top 82 and side walls 72, 74 that are tapered at a first end 76 of the slider 70. The top 82 is positioned above the closure profiles 40, 42, and the side walls 74, 72 are positioned outside and along the closure profiles 40, 42, respectively. Thus, the top 82 and the side walls 72, 74 form a cavity that receives the male and female closure profiles 40, 42. The slider 70 further has first and second guide posts 71, 73 attached to it. The guide posts 71, 73 extend down or depend from the top 82 of the slider 70 and are generally projecting from the top 82. The first and second guide posts 71, 73 extend partially through the length of the slider 70. The first guide post 71 is positioned above the male closure profile 40. The second guide post 73 is positioned above the female closure profile 42. The guide posts 71, 73 aid in aligning the male closure profile 40 with the female closure profile 42 for interlocking.

The slider 70 further has a separator or plow 78 attached to it. The plow 78 also extends down from the top 82 of the slider 70 and is generally shaped as an upside-down T. The plow 78 has a top end 86 and a bottom end 88. The top end 86 of the plow 78 is attached to the slider 70 at a second end 80 of the slider 70 and extends partially through the length of the slider 70. The plow 78 does not exist at the first end 76 of the slider 70 where the side walls 72, 74 are tapered. The bottom end 88 of the plow 78 has first and second arms 87, 89. The arms 87, 89 extend out from the plow 78 and are generally parallel to the top 82 of the slider 70. First and second arms 87, 89 and stem 85 collectively form the upside-down T shape of plow 78. The first arm 87 is positioned below the male closure profile 40. The second arm 89 is positioned below the female closure profile 42. The arms 87, 89 aid in aligning the male closure profile 40 and the female closure profile 42 for interlocking. Note that for the preferred slider 70 shown, the first arm 87 has a thicker cross-section than the second arm 89. This is due to the specific profile shapes of the male and female profiles 40, 42. It has been found, in preferred systems, that it is desirable to have the first and second arms 87, 89 slidably engage or touch or abut respective male and female profile members 40, 49.

Referring back to FIG. 1, when the slider 70 is moved in a first, sealing direction A along the top edge of the package 10, the tapered shape of the side walls 72, 74 (FIG. 3) of the slider 70 applies pressure to the closure profiles 40, 42 (FIG. 3) pinching them together behind the slider 70 as the slider 70 moves forward. Interlocking the closure profiles 40, 42 of the resealable slider closure mechanism 14 seals the mouth 26 of the package 10, preventing the contents of the package 10 from spilling out.

The plow 78 (FIG. 3) separates the closure profiles 40, 42. When the slider 78 is moved in a second, opposite, opening direction B along the top edge of the package 10, the plow 78 forces the closure profiles 40, 42 apart, providing access to the contents of the package 10. The closure profiles 40, 42, typically, are sealed together at their side edges, such as side edges 20, 22 of the package 10. These side seals prevent the slider 70 from traveling past the side edge 22 of the package 10 in the sealing direction A and from traveling past the side edge 20 in the opening direction B.

Generally, to seal the package 10, a package user slides the slider 70 in the sealing direction A across the top of the package 10. The tapered side walls 72, 74 (FIG. 3) apply pressure to the closure profiles 40, 42 (FIG. 3) interlocking them as the slider 70 travels in the sealing direction A. The slider 70 comes to rest against the side edge 22, sealing the mouth 26 of the package 10. Generally, to open the package 10, the package user slides the slider 70 in the opposite, opening direction B. The plow 78 (FIG. 3) separates the closure profiles 40, 42, opening the resealable closure mechanism 14. The slider 70 comes to rest against the side edge 20, providing access to the contents of the package 10 through the mouth 26.

Referring back to FIG. 3, the slider 70 is manufactured separately from the closure profiles 40, 42 and is attached to the closure profiles 40, 42 at a later point in the manufacturing process. Preferably, the side walls 72, 74 and the top 82 of the slider 70 comprise one unitary slider mechanism 70. In the present invention, the plow 78 is manufactured separately from the slider 70. The plow 78 is attached to the slider 70 at the same time the slider 70 is attached to the closure profiles 40, 42. For example, the plow 78 is inserted between the closure profiles 40, 42; the slider 70 is placed over and around the closure profiles 40, 42; and the plow 78 is attached to the slider 70 by one of a variety of methods.

Figure 4:
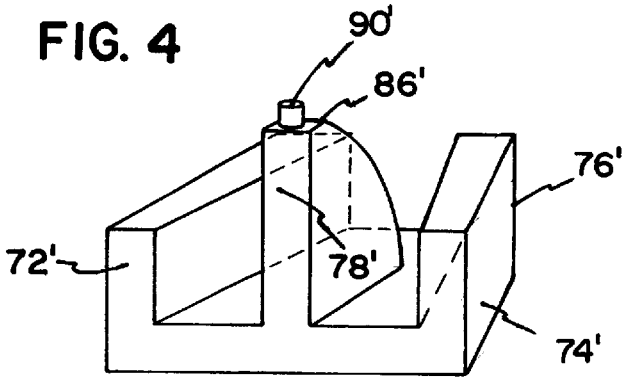
FIG. 4 is a perspective view of a plow of a slider mechanism, according to an example embodiment of the present invention.

In one embodiment of the present invention, the plow 78 has an attachment peg 90 that extends from the top end 86 of the plow 78, similar to the attachment peg 90' of the plow 78' of FIG. 4. The attachment peg 90 is generally cylindrical in shape and has its central axis perpendicular to the top end 86 of the plow 78. The slider 70 additionally has a peg housing or cavity 91 in the top 82 that is adapted to receive the attachment peg 90. Of course, in alternative embodiments, the attachment peg could extend down from the slider 70 while the plow 78 has a cavity for receiving the attachment peg.

In one example embodiment, the diameter of the cavity 91 is equal to the diameter of the attachment peg 90. Preferably, in this embodiment, the diameter of both the attachment peg 90 and the cavity 91 is between 0.005 inches (0.13 mm) and 0.040 inches (1.016 mm). Typically, the diameter of both the attachment peg 90 and the cavity 91 is 0.020 inches (0.508 mm). The attachment peg 90 is secured within the cavity 91 by a press-fit. By the term "press-fit," it is meant that friction between the walls of the cavity 91 and the attachment peg 90 hold the attachment peg 90 in place within the cavity 91, securing the plow 78 to the slider 70.

Figure 5:
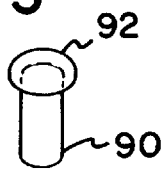
FIG. 5 is a perspective view of an attachment peg of the plow of FIG. 3 according to an example embodiment of the present invention.

Attention is directed to FIG. 5. In another example embodiment, a tip 92 of the attachment peg 90 has a larger diameter than the cavity 91, creating a "snap-fit." By the term "snap-fit," it is meant that the larger diameter of the tip 92 of the attachment peg 90 allows the attachment peg 90 to be pushed into the cavity 91 and then locked into place within the cavity 91, securing the plow 78 to the slider 70. Preferably, in this snap-fit embodiment, the diameter of the attachment peg 90 is between 0.005 inches and 0.040 inches; the diameter of the tip 92 is between 010 inches and 0.060 inches; and the diameter of the cavity 91 is between 0.005 inches and 0.045 inches. Typically. the diameter of the attachment peg 90 is 0.020 inches; the diameter of the tip 92 is 0.025 inches; and the diameter of the cavity 91 is 0.022 inches. In other words, the diameter of the tip 92 is 10% larger than the diameter of the cavity 91.

In yet another example embodiment, the diameter of the attachment peg 90 is smaller than the diameter of the cavity 91 and is attached by welding the attachment peg 90 into the cavity 91 by a process commonly known in the art, securing the plow 78 to the slider 70. Preferably, in this embodiment, the diameter of the attachment peg 90 is between 0.005 inches and 0.040 inches; and the diameter of the cavity 91 is between 0.010 inches and 0.060 inches. Typically, the diameter of the attachment peg 90 is 0.020 inches and the diameter of the cavity 91 is 0.025 inches. This means that the diameter of the peg is up to 20% smaller than the diameter of the cavity 91.

Figure 6:
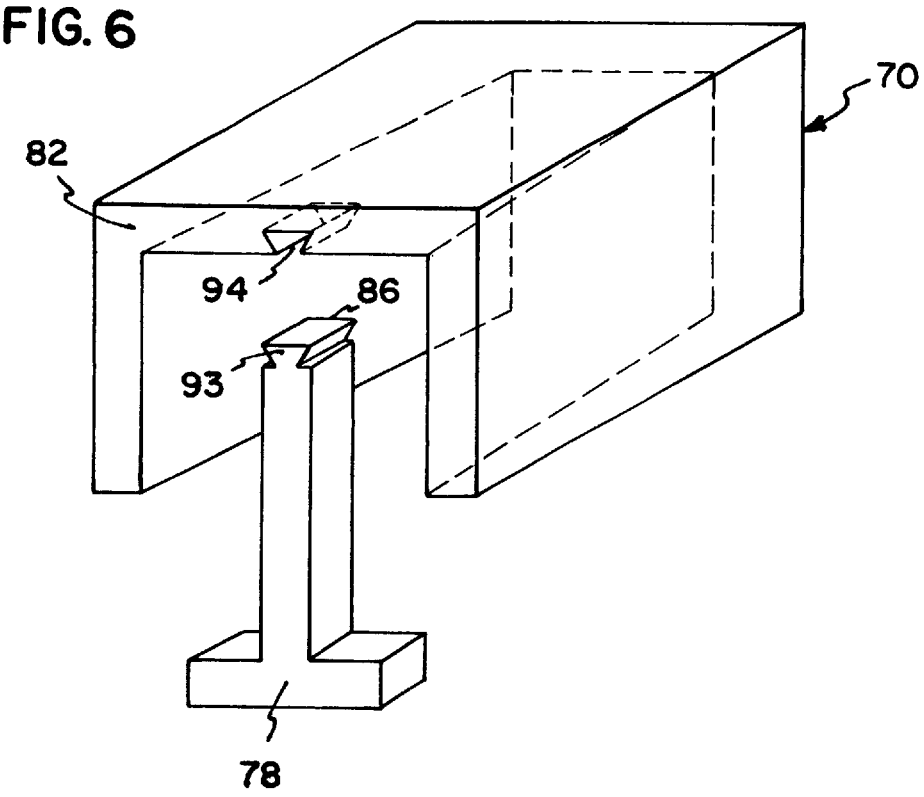
FIG. 6 is an exploded, perspective view of a slider mechanism, according to an example embodiment of the present invention.

Attention is directed to FIG. 6. In another example embodiment, the plow 78 is attached to the slider 70 by a tongue and groove. The top end 86 of the plow 78 has a tongue 93. In the preferred embodiment illustrated, the tongue 93 includes a cut-off triangular shape that has a length extending the entire depth of the top end 86 of the plow 78. A groove 94 positioned within the top 82 of the slider 70 is adapted to receive the tongue 93 of the plow 78. The groove 94 is preferably constructed to be the negative of the shape of the tongue 93. In the illustrated embodiment, the groove 94 is a cavity that has a cut-off triangular shape that has a length equal to the length of the tongue 93. Of course, in alternate embodiments, the tongue could extend down from the slider 70 while the groove is positioned within the plow 78.

In operation, the tongue 93 is slid into the groove 94 of the slider 70. Preferably, the tongue 93 fits tightly within the groove 94 so that friction keeps the tongue 93 from sliding out of the groove 94. By the term "tightly," it is meant that the size of the tongue 93 is approximately equal to the size of the groove 94 such that friction keeps the tongue 93 within the groove 94, securing the plow 78 to the slider 70. Alternatively, the tongue 93 could be snapped into place similar to the "snap-fit" described previously, or by welding the tongue 93 in place by a process commonly known in the art.

Figure 7:
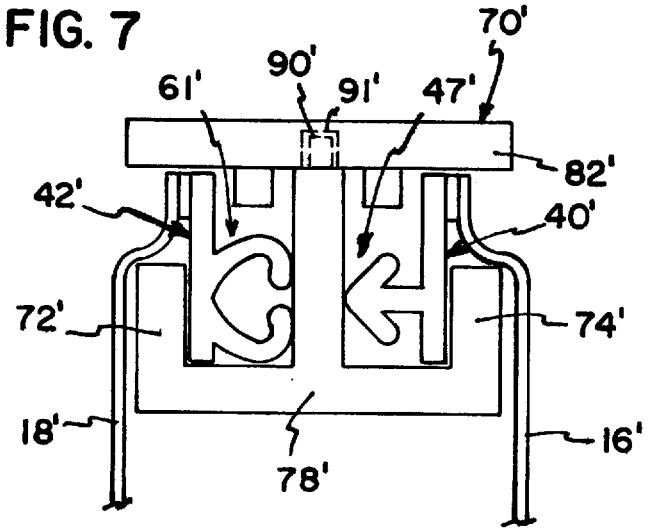
FIG. 7 is a fragmented, cross-sectional view of a resealable closure mechanism, according to another example embodiment of the present invention.

Attention is directed to FIG. 7. In another example embodiment of the present invention, the closure profiles 40', 42' are attached to the first and second panel sections 16',

18', respectively, above the interlocking closure members 47', 61'. In this embodiment, the slider 70' has only a top piece 82'. The top piece 82' can have one of a variety of shapes designed to facilitate the user's ability to open and close the closure mechanism 14. For example, the top piece 82' can be shaped to fit a user's fingers or a ring could be attached to the top piece 82' for grasping by the user. FIG. 4 illustrates one preferred plow construction for the FIG. 7 arrangement. In FIG. 4, the plow 78' includes the side walls 72', 74'. The side walls 72', 74' are tapered at a first end 76' to pinch the closure profiles 40', 42' together. The plow 78' is attached to the top 82' of the slider 70' by any one of the methods previously described, i.e., by press-fitting, snap-fitting, or welding through engagement between the peg 90' at the top end 86' and the cavity 91' (FIG. 7). FIG. 7 shows the plow 78' interlocked and secured to the top 82' of the slider 70'.

The above specification and examples are believed to provide a complete description of the manufacture and use of particular embodiments of the invention. Many embodiments of the invention can be made without departing from the spirit and scope of the invention.

We claim:

1. A resealable package comprising:

(a) first and second panel sections joined together to define an enclosed region; first and second opposite side edges; a top edge; and a mouth providing access to the enclosed region; and (b) a closure arrangement secured to the first and second panel sections for selectively opening and sealing the mouth; the closure arrangement including:

(i) a first closure profile including a first base strip and a first interlocking closure member;

(ii) a second closure profile including a second base strip and a second interlocking closure member;

(A) the first and second interlocking closure members arranged and configured to selectively engage;

(iii) a slider including a top piece positioned above the first and second closure profiles, the top piece defining a single, centrally located groove that faces in a downward direction toward the first and second closure profiles;

(iv) a plow having a top end and a bottom end, the top end including an upwardly projecting tongue adapted to a fit within the groove defined by the top piece of the slider; the slider and the plow being arranged and configured to:

(A) form a first cavity for receiving the first and second closure profiles;

(B) slide along the first and second closure profiles in a first direction to cause the first and second closure profiles to engage; and (C) slide along the first and second closure profiles in a second direction to cause the first and second closure profiles to disengage.

2. A resealable package according to claim 1, wherein the first closure profile further includes a first sealant layer attached to the first base strip; the first sealant layer adapted for attachment to the first panel section of the package.

3. A resealable package according to claim 2, wherein the second closure profile further includes a second sealant layer attached to the second base strip; the second sealant layer adapted for attachment to the second panel section of the package.

4. A resealable package according to claim 1, wherein the slider also includes first and second side walls tapered at a first end to cause the first and second closure profiles to engage.

5. A resealable package according to claim 1, wherein the top piece of the slider includes a length, and the groove extends only partially along the length.

* * * * *